US010203180B2

(12) United States Patent
Miller et al.

(10) Patent No.: US 10,203,180 B2
(45) Date of Patent: Feb. 12, 2019

(54) MISSILE CANISTER GATED OBTURATOR

(71) Applicant: BAE Systems Land & Armaments, L.P., Santa Clara, CA (US)

(72) Inventors: Mark J. Miller, St. Louis Park, MN (US); Peter C. Woods, Champlin, MN (US)

(73) Assignee: BAE Systems Land & Armaments L.P., Santa Clara, CA (US)

( * ) Notice: Subject to any disclaimer, the term of this patent is extended or adjusted under 35 U.S.C. 154(b) by 0 days.

(21) Appl. No.: 15/839,211

(22) Filed: Dec. 12, 2017

(65) Prior Publication Data

US 2019/0017780 A1 Jan. 17, 2019

Related U.S. Application Data

(62) Division of application No. 14/586,414, filed on Dec. 30, 2014, now Pat. No. 9,874,420.

(60) Provisional application No. 61/921,920, filed on Dec. 30, 2013.

(51) Int. Cl.
*F41F 3/04* (2006.01)

(52) U.S. Cl.
CPC ..... *F41F 3/0413* (2013.01)

(58) Field of Classification Search
CPC .. F41F 3/042; F41F 3/048; F41F 3/052; F41F 3/0413; F41F 3/04
USPC ..... 89/1.817, 1.816, 1.819, 1.8, 17, 26, 1.7, 89/1.703; 211/60.1; 244/137.1
See application file for complete search history.

(56) References Cited

U.S. PATENT DOCUMENTS 2,445,423 A * 7/1948 Eastman ..... F41F 3/0413 206/3
2,480,328 A * 8/1949 Johnston ..... F41A 17/22 42/69.01
2,696,760 A * 12/1954 Musser ..... F41A 1/08 89/1.703
3,041,017 A * 6/1962 Sieve ..... B64F 1/06 244/63
3,087,386 A * 4/1963 Rung ..... F41F 3/07 114/317
3,421,410 A * 1/1969 Kayaian ..... F41A 19/59 89/1.807
3,610,096 A * 10/1971 Bauman et al. ..... F42B 10/30 244/3.23

(Continued)

*Primary Examiner* — John Cooper
(74) *Attorney, Agent, or Firm* — Patterson Thuente Pedersen, P.A.

(57) ABSTRACT

Apparatus and methods relating to a missile canister that utilizes a variable obturator assembly. The variable obturator assembly can include a plurality of gates that adjust based upon canister pressure at a base plate. In a maximum pressure situation experienced during successful missile egress from the canister, one or more of the gates can open in response to canister flyout pressure so as to increase flow area through the base plate, thereby reducing canister pressure. In a restrained firing scenario, the plurality of gates remain closed thereby preventing missile exhaust gases from flow up past the base plate which could lead to heating of a rocket motor and warhead. The variable obturator assembly can have multiple individual gates that are mounted to the base plate with a hinge assembly, with the gates held in a closed position against the base plate with a spring assembly.

10 Claims, 6 Drawing Sheets

(56) References Cited

U.S. PATENT DOCUMENTS

| | | | | | |
|---|---|---|---|---|---|
| 4,044,648 | A * | 8/1977 | Piesik | F41F 3/0413 | 89/1.8 |
| 4,134,327 | A * | 1/1979 | Piesik | F41F 3/077 | 89/1.8 |
| 4,173,919 | A * | 11/1979 | Piesik | F41F 3/0413 | 89/1.8 |
| 4,186,647 | A * | 2/1980 | Piesik | F41F 3/077 | 89/1.8 |
| 4,203,347 | A * | 5/1980 | Pinson | F41A 1/08 | 89/1.703 |
| 4,324,167 | A | 4/1982 | Piesik | | |
| 4,796,510 | A | 1/1989 | Piesik | | |
| 5,136,922 | A * | 8/1992 | Piesik | F41F 3/0413 | 89/1.812 |
| 5,162,605 | A | 11/1992 | Piesik | | |
| 5,194,688 | A * | 3/1993 | Piesik | F41F 3/0413 | 89/1.8 |
| 5,206,450 | A * | 4/1993 | Piesik | F41F 3/0413 | 89/1.8 |
| 6,079,310 | A * | 6/2000 | Yagla | F41F 3/0413 | 89/1.816 |
| 6,427,574 | B1 * | 8/2002 | Callahan | F41F 3/07 | 89/1.81 |
| 6,584,882 | B2 * | 7/2003 | Briggs | F41F 3/0413 | 89/1.817 |
| 8,353,239 | B1 * | 1/2013 | Patel | F41F 3/0413 | 89/1.819 |
| 8,443,707 | B2 | 5/2013 | Skurdal et al. | | |
| 8,584,569 | B1 | 11/2013 | Whitney et al. | | |
| 2006/0214062 | A1 * | 9/2006 | Shim | F41F 3/00 | 244/137.1 |
| 2008/0041222 | A1 * | 2/2008 | Barisciano, Jr. | F41F 3/0413 | 89/36.15 |

* cited by examiner

MISSILE CANISTER GATED OBTURATOR

RELATED APPLICATION

The present application is a Divisional of U.S. patent application Ser. No. 14/586,414, filed Dec. 30, 2014, entitled "MISSILE CANISTER GATED OBTURATOR" which claims the benefit of U.S. Provisional Application No. 61/921,920 entitled "MISSILE CANISTER GATED OBTURATOR", filed Dec. 20, 2013, which are incorporated herein by reference in their entirety.

FIELD OF THE INVENTION

The present invention is generally related to the field of missile canisters. More specifically, the present invention is directed to a missile canister having a variable obturator system that provides for sealed obturation during restrained firing events while also allowing for reduced canister pressures during missile egress.

BACKGROUND OF THE INVENTION

Modern warships use missiles as offensive and defensive weapons. Vertical Launch Systems ("VLS") provide a missile firing platform for surface ships and submarines throughout the world. Generally, a VLS is made up of a number of cells, wherein each cell includes at least one individual missile canister. Loaded within each missile canister is an individually firable missile. Within each cell, a variety of different missile designs can be included so as allow for the performance of various missions including for example, anti-aircraft, anti-submarine, strike, naval surface fire support and ballistic missile defense missions. The individual cells are located below a ship's deck providing increased system survivability while reducing the ship's radar cross-section as compared to prior deck mounted systems.

Encapsulating missiles within a canister is desirable because it provides a convenient and safe way to ship, handle and launch the missiles. The operation of the missile within the canister and in firing must be managed due to the potential hazards. In designing a VLS, missiles can be ejected from their individual canisters by ignition within the canister, i.e. a hot launch, or using a non-missile gas followed by ignition of the missile outside the canister, i.e. a cold launch. One advantage of a hot launch system is that the missile is expelled by its own means and thus, an additional ejection mechanism such as, for example, a gas generator and associated structure, is unnecessary. This allows hot launch systems to be smaller and more lightweight as compared to cold launch systems. However, the individual canisters of a hot launch system must be designed to withstand the temperature and pressure associate with igniting the missile within the canister.

Not only must the canisters be designed to withstand the canister flyout pressure during a successful missile egress but in addition, the canister must be able to withstand an unsuccessful missile egress or restrained firing scenario in which the missile is ignited but otherwise fails to exit the canister. The restraint means for the missile, i.e. the means for securing the missile in its associated canister, could fail when the missile was fired. Protection against the hazards associated with such restrained firings was provided in the prior art launchers in the form of a deluge and drain system. Provision for such a system undesirably added to the complexity, cost, maintenance and weight of the launcher.

Increased weight is particularly undesirable when the launcher is to be installed aboard a ship.

In order to further reduce both manufacturing costs and cell weight, it would be advantageous to improve upon existing canister design such that the weight of individual canisters can be reduced while still providing exceptional performance in both restrained firing and successful missile egress situations.

SUMMARY OF THE INVENTION

The present invention is directed to a missile canister for use in a VLS that utilizes a variable obturator assembly. The missile canister is generally rectangular in shape although may be circular. The canister has a forward closure aligned with the nose of a missile and an aft closure, aligned with the exhaust nozzles of the missile. The canister generally includes internal missile guide surfaces and booster lateral support assemblies for directing the missile from the canister. The canister is defined by an outer wall which maybe rectangular, square of circular. The canister will also include an electrical assembly for connection of the firing and control system to the missile within the canister.

At the aft closure end of the canister is an obturator. The obturator is typically a plate like structure with a central opening. The central opening seals around the missile exhaust nozzle while the edges of the plate seal to the sides of the canister. The obturator is positioned to control the flow of the exhaust gas from the missile.

In the present invention, the obturator has a plurality of gates. The variable obturator assembly can comprise a plurality of gates that adjust based upon canister pressure at a base plate. In a maximum pressure situation experienced during successful missile egress from the canister, one or more of the gates can open in response to canister flyout pressure so as to increase flow area through the base plate, thereby reducing canister pressure. In a restrained firing scenario, the plurality of gates remain closed thereby preventing missile exhaust gases from flow up past the base plate which could lead to heating of a rocket motor and warhead.

In one representative embodiment, the variable obturator assembly can comprise three individual gates that are mounted to the base plate with a hinge assembly. Each gate can be forcibly held in a closed position against the base plate with a spring assembly. Each spring assembly can be selected to have a spring force sufficient to hold the gate closed against the base plate during a restrained firing event. At the same time, the spring force is selected to be less than the canister flyout pressure such that each gate rotatably opens with respect to the base plate during missile egress.

In one aspect, the present invention is directed to a VLS filled with missile canisters having a variable obturator assembly.

In another aspect, the present invention is directed to a missile canister comprising a variable obturator assembly.

In another aspect, the present invention is directed a variable obturator assembly.

In another aspect, the present invention is directed to a method of fabricating a missile canister having a variable obturator assembly.

In another aspect, the present invention is directed to a method of reducing canister flyout pressure with a variable obturator assembly during missile egress from a VLS.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be more completely understood and appreciated by referring to the following more detailed description of the presently preferred exemplary embodiments of the invention in conjunction with the accompanying drawings, of which.

DETAILED DESCRIPTION OF THE DRAWINGS

Figure 1:
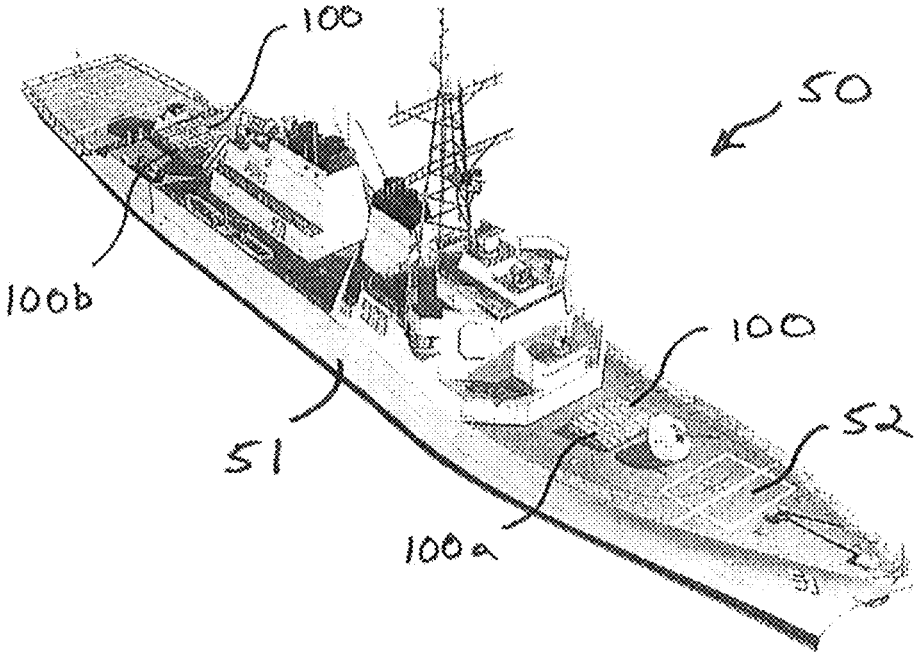
FIG. 1 PRIOR ART
FIG. 1 is a top, perspective view of a naval ship of the prior art having a pair of Vertical Launch System mounted in a ship deck.

As illustrated in FIG. 1, a ship 50 can comprise a hull 51 and a deck 52. Ship 50 can comprise a wide variety of variants including for example, an Arleigh Burke class destroyer as depicted in FIG. 1 or alternative, various classes of destroyers, frigates, cruisers, littoral zone ships, transport ships and even attack submarines. As part of the armament of ship 50, one or more Vertical Launch Systems (VLS) 100 can be mounted within deck 52. Depending upon the size and mission requirements for ship 50, ship 50 can be equipped two or more batteries of VLS 100, such as, for example, a fore VLS 100*a* and an aft VLS 100*b*.

Figure 2:
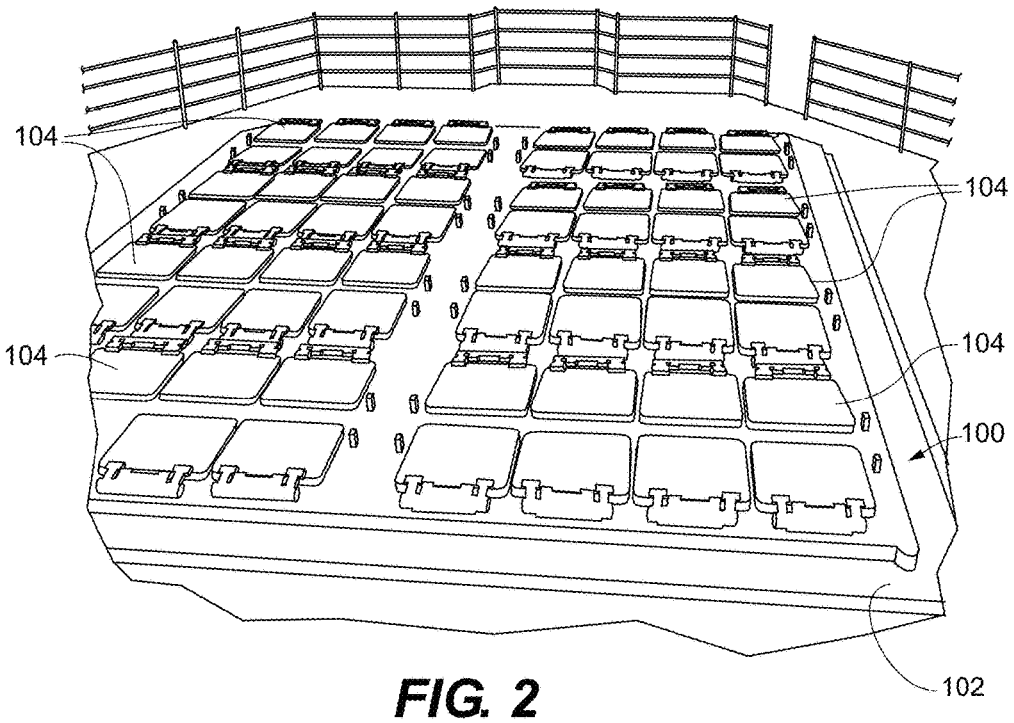
FIG. 2 PRIOR ART
FIG. 2 is a top, perspective view of a ship deck of the prior art including a deck mounted Vertical Launch System.
Figure 3:
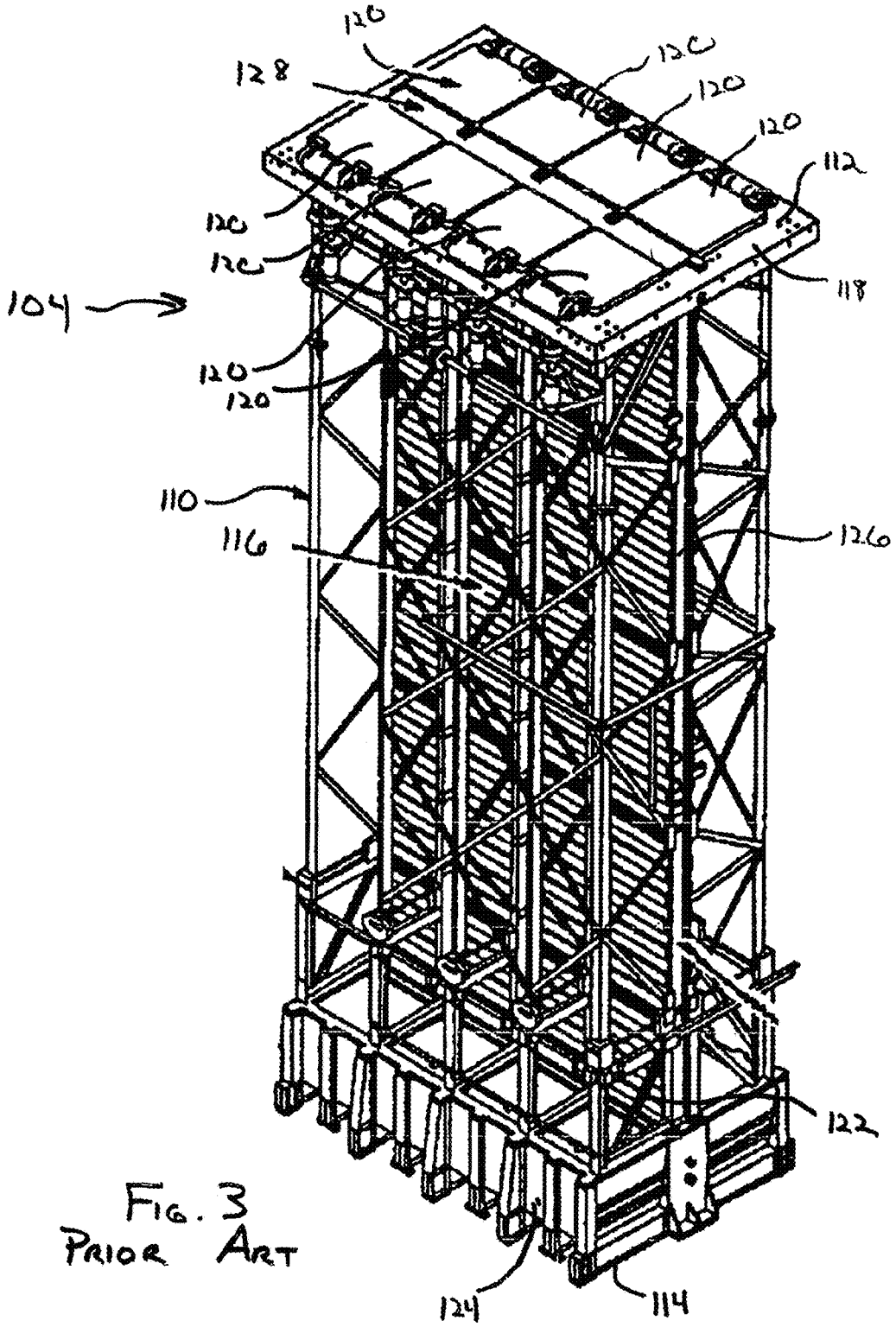
FIG. 3 PRIOR ART
FIG. 3 is a top, perspective view of a vertical launch cell of the prior art.

As seen in FIGS. 2 and 3, VLS 100 can comprise a deck mount 102 for positioning and mounting the VLS 100 in the deck 52. Generally, VLS 100 comprises one or more cells 104 that are individually positionable within the deck mount 102. For example, the VLS 100 as illustrated in FIG. 2 includes eight cells 104. Cells 104 generally comprise a plurality of missile canisters 106. One advantage of VLS 100 is that each cell 104 can be uniquely configured both in the number of missile canisters 106 per cell 104 (for example, a 2×4 arrangement as shown in FIGS. 2 and 3 with 2 rows of 4 missile canisters 106 per cell) and missile types within each cell 104. For example, within a single cell 104, a VLS 100 can include anti-aircraft, anti-submarine, strike, naval surface fire support and ballistic missile defense missiles.

Referring to FIGS. 2 and 3, each cell 104 generally comprises a cell frame 110 having an upper deck structure 112, a lower base structure 114 and an outboard structure 116 extending there between. Upper deck structure 112 generally comprises a cell hatch 118 having a plurality of upwardly rotatable canister doors 120. The number of canister doors 120 generally corresponds to the number of individual missile canisters 106 in cell 104, for example eight canister doors 120 as seen in FIGS. 2 and 3. Cell 104 further comprises a gas management system 122 including a base plenum 124 (located in the lower base structure 114), an uptake plenum 126 (extending the height of the outboard structure 116 between the lower base structure 114 and the upper deck structure 112) and an upwardly rotatable uptake hatch 128 (mounted in the cell hatch 118 between the rows of upwardly rotatable canister doors 120). Directly below each canister door 120, the outboard structure 116 defines individual canister cells 122 for receiving the missile canisters 106. Each canister cell 122 includes a canister latch assembly 124 for physically coupling and restraining the associated missile canister 106. Though not necessary for the understanding of the present invention, it will be understood that cell frame 110 includes additional features and systems relating to operational control and safety including, for example, electrical power and control systems, missile restraining systems and deluge systems.

Figure 4:
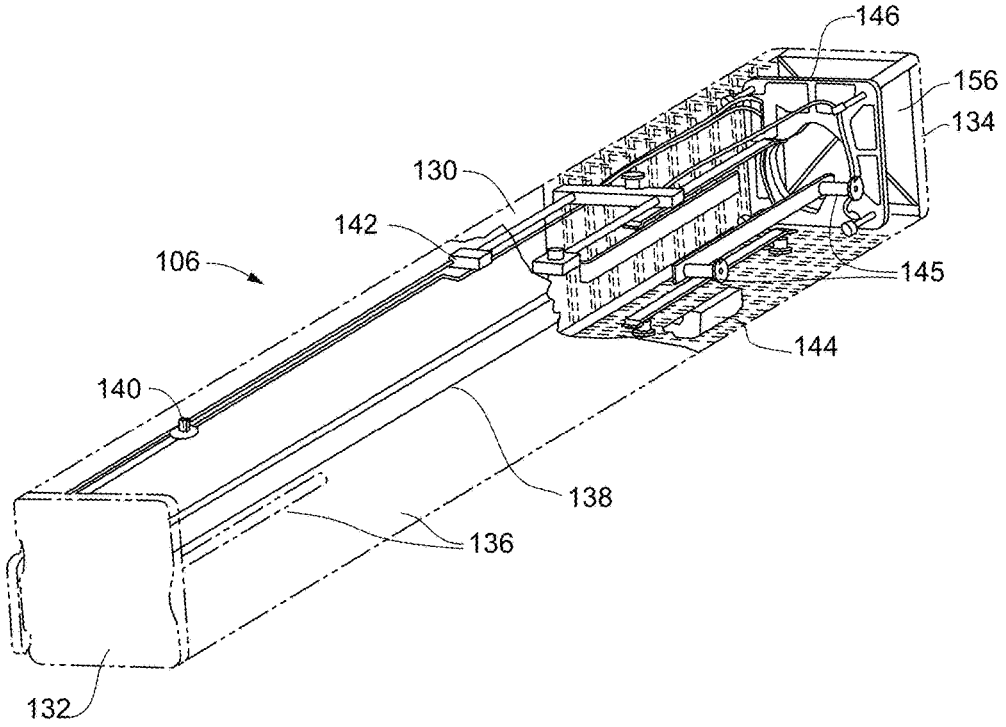
FIG. 4 is a partially hidden, perspective view of a missile canister according to an embodiment of the present invention.

As illustrated in FIG. 4, each missile canister 106 comprise a four sided canister shell structure 130, a forward (or top) closure 132 and an aft (or bottom) closure 134. Within the shell structure 130, a variety of structures are used to support, restrain, store, control, power and potentially quench missiles. These include missile guide surfaces 136, guide rails 138, deluge assembly 140, electrical assembly 142, desiccant assembly 144 and lateral support assemblies 145. A variable obturator assembly 146 is located proximate the aft closure 134. The variable obturator assembly 146 manages exhaust gas flow following ignition of a rocket engine within individual missiles.

Figure 6:
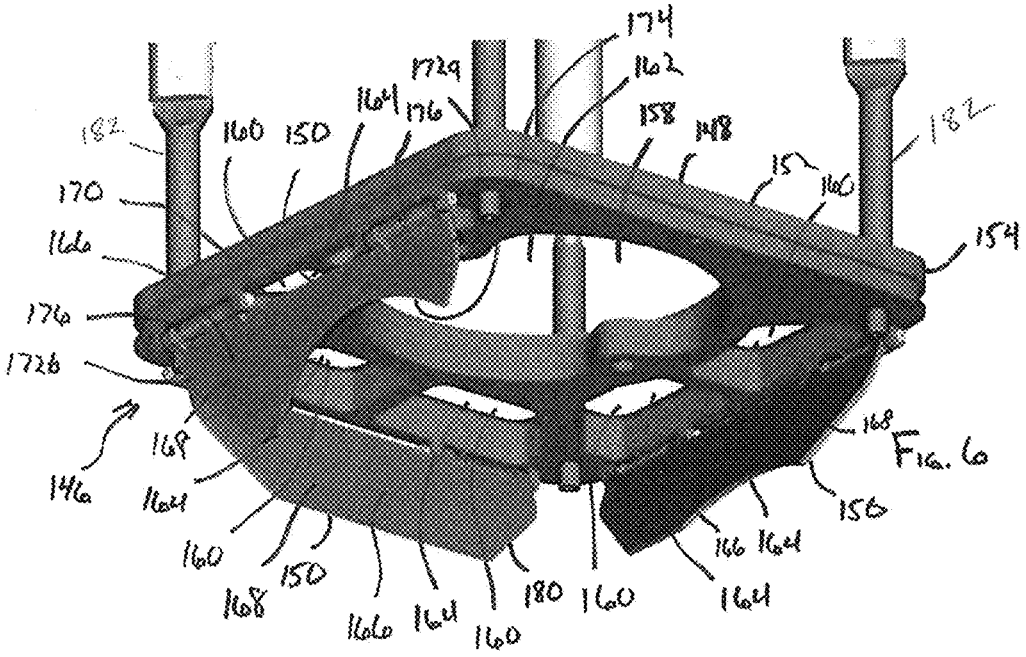
FIG. 6 is a bottom, perspective view of the obturator assembly of FIG. 5 in an open gate position according to an embodiment of the present invention.
Figure 5:
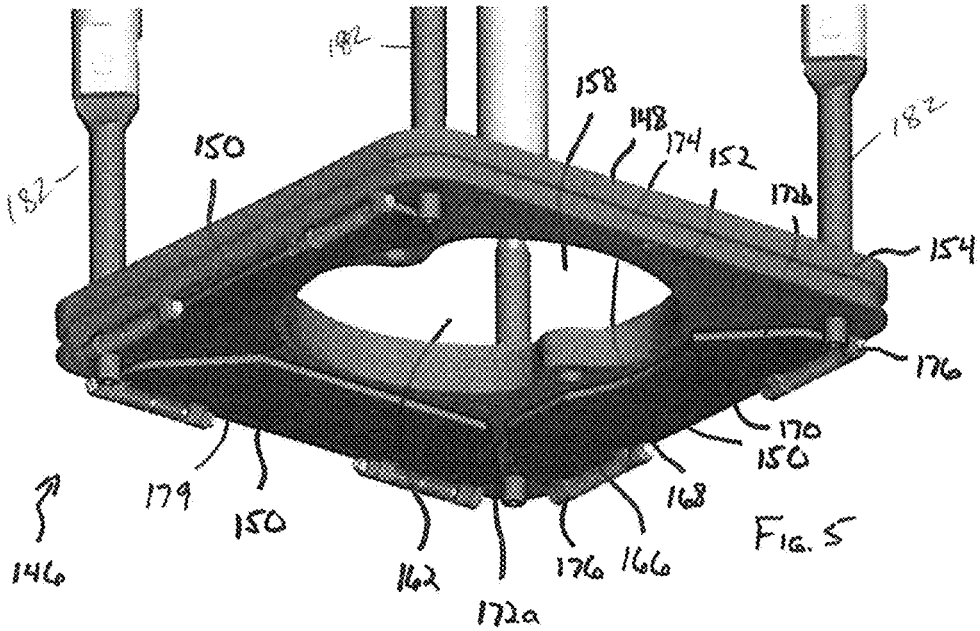
FIG. 5 is a bottom, perspective view of an obturator assembly in a closed gate position according to an embodiment of the present invention.

As seen in FIGS. 5 and 6, a representative embodiment of the variable obturator assembly 146 of the present invention comprises an obturator plate 148 and a plurality of obturator gates 150. Obturator plate 148 generally has a plate surface 152 defined by a plate perimeter 154. Plate perimeter 154 generally matches and snugly fits across an internal shell cross-section 156 of the canister shell structure 130. Plate surface 152 includes a central obturator opening 158 and one or more peripheral obturator openings 160. Central obturator opening 158 is selectively sized to have a desired central opening area 162. Peripheral obturator openings 160 are selectively sized to have a desired peripheral opening area 164. Obturator plate 148 can be designed and constructed to include any number of peripheral obturator openings 160, for example, two peripheral obturator openings 160 along three sides of the obturator plate 148 and one side lacking any peripheral obturator openings 160. In choosing a particular layout for obturator plate 148 including, for example, the number of obturator gates 150, size and shape of central opening area 162 and the number and shape of peripheral opening areas 164, the obturator plate 148 is designed to maximize ignition, firing and egress characteristics of particular missile designs.

As seen in FIGS. 5 and 6, variable obturator assembly 146 will have obturator gates 150 that correspond to the arrangement of peripheral obturator openings 160 on the obturator plate 148. For example three obturator gates 150 are rotatably opened and closed to either expose or cover the six peripheral obturator openings 160 located on three sides of the obturator plate 148. In some non illustrated embodiments, it will be understood that multiple obturator gates 150 can be utilized on each side of the obturator plate 148, for example, two obturator gates 150, each covering a single peripheral obturator opening 160. Each obturator gate 150 generally comprises a gate body 166 having a gate body area 168. The gate body 166 includes a hinge attachment end 170, a pair of gate sides 172*a*, 172*b* and a forward end 174. Attached to hinge attachment end 170 is one or more spring hinges 176 that rotatably couple the gate body 166 to the obturator plate 148 proximate the plate perimeter 154. Spring hinges 176 generally function to hold the gate body 166 against the obturator plate 148 in a closed gate disposition 179 as shown in FIG. 5 such that the obturator gates 150 block off or otherwise restrict air flow through the covered peripheral obturator openings 160. Each spring hinge 176, used either individually or combined in pairs, is selected to have a desired spring force a. When gas flow having a pressure exceeding spring force a is directed through the peripheral obturator openings 160, each obturator gate 150 begins to rotate around the corresponding spring hinge 176 such that the peripheral obturator openings 160 are uncovered, thereby assuming an open gate disposition 180 as shown in FIG. 6, which allows for gas flow through the peripheral obturator openings 160. The obturator plate 148 further includes rods 182 mounted approximate the corner of the plate to control travel of the obturator plate.

Figure 7:
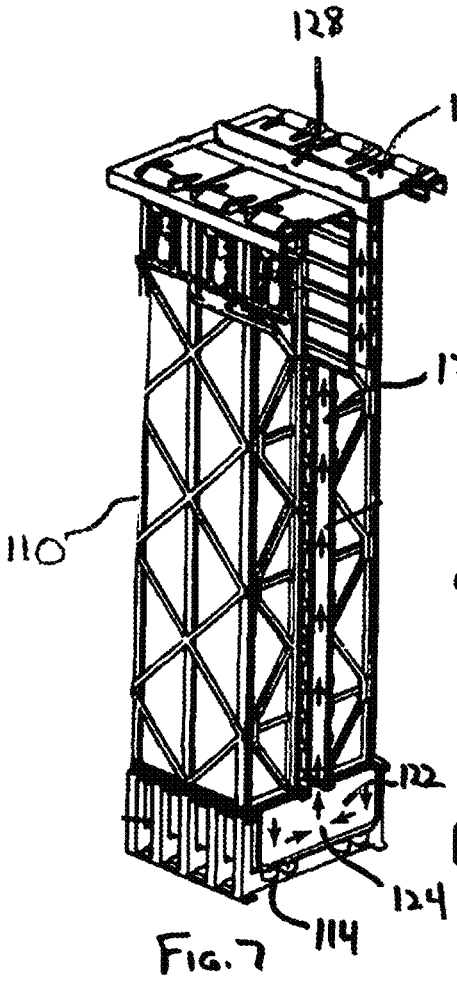
FIG. 7 PRIOR ART
FIG. 7 is a top, perspective view of the vertical launch cell of FIG. 3 illustrating a gas containment system.
Figure 8:
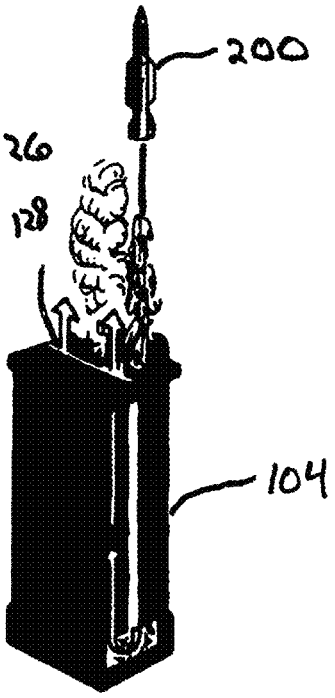
FIG. 8 PRIOR ART
FIG. 8 is a top, perspective, partially hidden view of the vertical launch cell of FIG. 3 illustrating a successful missile egress.

In a successful missile deployment from missile canister 106, a variety of events unfold as shown in FIGS. 7 and 8. Generally, a missile selection and ignition command is transmitted to the VLS, whereby a particular missile 200 is selected and prepared for deployment.

Generally, the canister door 120 corresponding to missile 200 is opened and a rocket motor in the missile 200 is ignited causing missile exhaust gases to be directed downward toward the lower base structure 114 and out the gas management system 122. Within missile canister 106, the missile exhaust gases generate a pressure exceeding spring force a, such that the obturator gates 150 rotate from the closed gate disposition 178 to the open gate disposition 180. As the obturator gates 150 reach the open gate disposition 180, a canister flyout pressure β experienced by canister shell structure 130 is reduced as the missile 200 egresses the missile canister 106. Canister flyout pressure β is the highest pressure condition typically experienced by missile canister 106 and thus, canister flyout pressure β is the primary design criteria utilized for safely designing canister shell structure 130. By reducing canister flyout pressure β, it is possible to reduce the size and weight of the materials used in constructing the canister shell structure 130. Reducing the size and weight of the materials used in constructing canister shell structure 130 has a number of benefits including reducing the overall weight of VLS 100, reducing the weight of individual missile canisters 106, reducing the material costs for individual missile canisters 106 and making it easier to reload cell 104 with missile canisters 106.

In the event of an unsuccessful missile deployment or restrained firing scenario, the rocket motor is ignited but for whatever reason, missile 200 fails to egress from missile canister 106. Even with the rocket motor ignited, restraining features on the cell frame 110 and within missile canister 106 retain missile 200 and prevent it from egressing the missile canister 106. As the missile 200 does not egress the missile canister 106, canister flyout pressure β is never achieved such that obturator gates 150 remain in the closed gate disposition 178. As such, the exhaust gases are directed solely through the central obturator opening 158 and vented out gas management system 122. In a restrained firing scenario, the rocket motor can be ignited for up to six seconds before the deluge system quenches missile 200. Throughout the restrained firing scenario, the obturator gates 150 remain in closed gate disposition 178.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

The invention claimed is:

1. A method for reducing canister pressure when firing a missile from a vertical launch system, the method comprising:

mounting a missile within a canister, said canister comprising a forward end and an aft end and a central axis extending from the forward end to the aft end, said forward end disposed approximate a missile nose while the aft end is disposed proximate a missile exhaust nozzle;

attaching an obturator plate to the canister approximate the nozzle;

positioning at least one obturator gate on the said obturator plate, said obturator gate in a closed position prior to firing and transitionable to an open position after firing the missile; and firing the missile;

wherein firing the missile creates a flyout pressure that opens the obturator gate to increase the opening size of the obturator plate, said increase in obturator opening size reduces the shell pressure;

wherein the obturator gate does not open when the missile is fired in a restrained firing mode.

2. The method for reducing canister pressure of claim 1 further including attaching the obturator gate to the obturator plate by a hinge assembly.

3. The method for reducing canister pressure of claim 2 wherein the hinge assembly has a spring, said spring having a spring force set to open only during an actual launch event.

4. The method for reducing canister pressure of claim 1 wherein three obturator gates are opened during flyout of the missile.

5. The method for reducing canister pressure of claim 1 wherein the obturator plate has a first opening without a gate.

6. A method for avoiding overheating a missile during a launch, the method comprising:

mounting the missile within a canister, the canister disposed within a vertical launch system of a ship, said canister comprising a forward end and an aft end and a central axis extending from the forward end to the aft end, said forward end disposed approximate a missile nose while the aft end is disposed proximate a missile exhaust nozzle;

attaching an obturator plate to the canister approximate the nozzle;

positioning at least one obturator gate on the said obturator plate, said obturator gate in a closed position prior to firing and transitionable to an open position after firing the missile; and firing the missile;

determining whether the missile is in a restrained firing scenario or a egress scenario;

opening the obturator gates for the egress scenario; and maintain a closed position for the restrained firing scenario.

7. The method for avoiding overheating a missile during a launch of claim 6 further including attaching the obturator gate to the obturator plate by a hinge assembly.

8. The method for avoiding overheating a missile during a launch of claim 7 wherein the hinge assembly has a spring, said spring having a spring force set to open only during an actual launch event.

9. The method for avoiding overheating a missile during a launch of claim 6 wherein three obturator gates are opened during flyout of the missile.

10. The method for avoiding overheating a missile during a launch of claim 6 wherein the obturator plate has a first opening without a gate.

* * * * *